US005450929A

United States Patent [19]

Ohgita et al.

[11] Patent Number: 5,450,929

[45] Date of Patent: Sep. 19, 1995

[54] CRANE EQUIPPED WITH A MAINTENANCE ELEVATOR

[75] Inventors: Kazuyoshi Ohgita; Tomokatsu Sugawara, both of Komaki, Japan

[73] Assignee: Daifuku Co., Ltd., Osaka, Japan

[21] Appl. No.: 139,510

[22] Filed: Oct. 19, 1993

[30] Foreign Application Priority Data

| | | | |
|---|---|---|---|
| Dec. 24, 1992 | [JP] | Japan | 4-343005 |
| Mar. 5, 1993 | [JP] | Japan | 5-044240 |
| Jun. 30, 1993 | [JP] | Japan | 5-160777 |
| Jul. 28, 1993 | [JP] | Japan | 5-185412 |

[51] Int. Cl.[6] ..... B66B 9/20

[52] U.S. Cl. ..... 187/244; 187/257; 414/279

[58] Field of Search ..... 187/240, 244, 235, 222, 187/257, 258; 414/508, 279, 277; 182/13, 14, 148, 141

[56] References Cited

U.S. PATENT DOCUMENTS

| | | | |
|---|---|---|---|
| 2,001,674 | 5/1935 | Erickson | 187/257 |
| 4,252,217 | 2/1981 | Benjamin | 414/279 |
| 4,599,030 | 7/1986 | Skaalen et al. | 187/244 |

*Primary Examiner*—Kenneth Noland

*Attorney, Agent, or Firm*—Barnes, Kisselle, Raisch, Choate, Whittemore & Hulbert

[57] ABSTRACT

A maintenance elevator 40 is employed in the case of an emergency situation such as a failure of the carriage 16 or in carrying out regular maintenance and checkup operations. An operator can get on the maintenance elevator 40 brought to a stop at its lowermost position. The maintenance elevator 40 is moved upward along a post 12 and is brought to a stop at any position in which, for example, a gangway 57 formed integrally with the elevator 40 is opposed to the carriage 16. Movement of the operator between the maintenance elevator 40 and the carriage 16 can be done by utilizing the gangway 57. Transfer from the maintenance elevator to the carriage and vice versa can be always made in an easy and safe manner by using the gangway. Provision of all the gangways at the maintenance elevator side realizes weight reduction at the carriage side, good energy saving, and cost reduction.

8 Claims, 14 Drawing Sheets

CRANE EQUIPPED WITH A MAINTENANCE ELEVATOR

FIELD OF THE INVENTION

The present invention relates to a handling apparatus for use in handling articles in, for example, an automatic housing facility and, more particularly, to a maintenance-elevator-equipped handling apparatus including a warehousing carriage and a maintenance elevator adapted for use in maintenance and check operations.

BACKGROUND OF THE INVENTION

Hitherto, a crane of this sort has been known as disclosed in Japanese Patent Application Laid-Open No. 1-313202 in which is proposed a travelling crane equipped with an elevator cab. In this prior art arrangement, the travelling crane includes a travelling body comprising a lower frame guided by a lower guide rail, an upper frame guided by an upper guide rail, and a pair of posts, front and rear, integrally connecting the two frames, and a carriage upward and downward movable between the two posts, with load transfer means mounted on the carriage.

A pair of guide rails, right and left, are mounted through a bracket to one of the posts on the outer side thereof as viewed from the direction of travel of the travelling body. An elevator cab is upward and downward movably carried on the guide rails and is equipped with brake means operable to act on the guide rails. Within the lower frame at a level below the posts there are provided a motor and a reduction gear for driving the elevator cab to move upward and downward, with a vertical run drive chain trained between a toothed drive wheel mounted to an output shaft of the motor or reduction gear and a toothed driven wheel disposed in the upper frame, the vertical run drive chain being connected to the elevator cab.

According to such prior art arrangement, the travelling crane can, when manually operated by an operator getting on a carriage-side cab or remotely operated from the ground side, perform load delivery to or load withdrawal from a target site of the rack through a combination of horizontal run of the travel body, vertical run of the carriage, and forking movement of load transfer means.

The elevator cab is used when emergency repairs are required due to, for example, a failure of the carriage or a load collapse occurring during the operation of the crane, as well as for regular maintenance and checkup purposes. In such a case, an operator gets on the elevator cab and manipulates a control panel provided in the cab to drive the motor to rotate the vertical drive chain forward and reverse, whereby the elevator cab will be moved upward and downward along the guide rail. When the elevator cab is brought to a stop at a position opposite to the carriage, the operator transfers from the elevator cab to the carriage to carry out the required repairs and/or maintenance and checkup work.

If the vertical run drive chain should become ruptured, the braking means, provided in opposed relation to the guide rails, will operate for braking action thereby to prevent the elevator cab from falling. The braking means is such that cam faces of brake elements act on flat surfaces of the guide rails, the cam faces being formed as serrated circumferential faces.

In the above described prior art arrangement, there is no provision of foothold or handle available for use by the operator in helping him transfer from the elevator cab to the carriage. This prevents such a transfer from being made in an easy and safe manner and even involves some danger in the case of such transfer at an elevated position.

The operation of the elevator cab for upward and downward movement is carried out via the control panel in the cab. The elevator cab has a window formed in its wall, which window provides only a narrow field of view because of the fact that the elevator cab is of a vertically rectangular box shape. Especially where the elevator cab is of such construction that its width or transverse length is further reduced, the one post obstructs the view from the window of the cab to the extent that there is available little field of view longitudinal of the path of movement of the travelling body, which does not permit any smooth and accurate operation of the cab for upward and downward movement. Where the elevator cab is so constructed that it has a larger transverse length to provide a wider field of view through its window, the cab is naturally larger in size and weight and, in addition, it will involve increased cost of operation of the travel crane per se because operation of the cab requires operation of the crane in conjunction therewith despite the fact that the elevator cab is used only occasionally.

In such arrangement wherein the elvator cab has a larger transverse length intended for provision of a wider field of view, it is not easy to operate the cab for upward and downward movement through the control panel while paying attention to the status of upward or downward movement of the cab, because the control panel is located away from the window. The elevator cab is usually positioned at its lowermost position and, therefore, an elevator cab having such a larger transverse length will substantially occupy the space between the travelling body and the rack, which does not permit easy passage of the elevator cab through that space.

The motor and the like for driving the elevator cab to move upward and downward are located within the lower frame, and the vertical run drive chain is trained about toothed driven wheels in the upper frame in a loop pattern. Therefore, the total length of the vertical run drive chain is about twice the length of the post. This results in greater shocks caused upon the elevator cab being started or brought to a stop, and results further in greater stretching of the chain due to the load applied (which, in this case, means the own weight of the elevator cab including the weight of the operator). Thus, the elevator cab is forced to get abruptly bounced (or subject to abrupt vertical jolting) when it is started or brought to a stop. The fact that the vertical run drive chain is of such a large length is disadvantageous in respect of cost. Furthermore, the fact that the motor and reduction gears are disposed within the lower frame does not permit easy maintenance and checkup.

Installing the pair of guide rails, right and left, to be acted upon by the brake means involves the steps of fixing a plurality of brackets to the post and fixing the guide rails between the upper and lower brackets. Further, additional fixing operations, such as welding, are required at a number of locations. As such, the operations involved in the installing work are very laborious to complete and are costly. Moreover, two sets of braking means are required and this further complicates the arrangement of the elevator cab as a whole. Another problem is that when, at each time of braking, the circumferential serrated portions act on flat surfaces of the guide rails, the circumferential serrated portions will bite into the respective guide rail surfaces to mar the guide rails, which eventually may lead to the braking elements being damaged including the circumferential serrated portions.

DISCLOSURE OF THE INVENTION

The objects of the present invention are to provide a maintenance elevator-equipped handling apparatus which permits easy and safe transfer between a carriage and a maintenance elevator; to provide a maintenance elevator-equipped handling apparatus in which the maintenance elevator is small-sized and lightweight and yet provides a wider field of view; to provide a maintenance elevator-equipped handling apparatus which, during its horizontal run, can easily clear a rack close to its maintenance elevator; to provide a maintenance elevator-equipped handling apparatus such that the starting and stopping of the maintenance elevator involves less shocks; to provide a maintenance elevator-equipped handling apparatus in which vertical run drive means for upward and downward movement of the maintenance elevator can be suitably arranged; to provide a maintenance elevator-equipped handling apparatus wherein a guide rail can serve concurrent purposes of guiding the maintenance elevator for upward and downward movement and preventing the maintenance elevator from falling; and to provide a maintenance elevator-equipped handling apparatus which has a fall preventive device capable of preventing the maintenance elevator from falling without any mar or damage being caused to the elevator.

In order to accomplish the foregoing objects, according to the present invention there is provided a maintenance elevator-equipped handling apparatus comprises a travelling body having a lower frame and a post extending upwardly from the lower frame, a carriage upwardly and downwardly movable along one side of the post as viewed in the direction of movement of the travelling body, and a maintenance elvator movable upwardly and downwardly along the other side of the post, said maintenance elevator being provided with a gangway located opposite to said carriage.

According to such arrangement, the maintenance elevator-equipped apparatus can, by being remotely operated or otherwise, perform load delivery to or load withdrawal from a target storage site of the rack through a combination of horizontal run of the travel body and vertical run of the carriage. All the required gangway is mounted to the maintenance elevator. This is advantageous in that the carriage side weight is reduced and the energy requirement for warehousing operations can be reasonably reduced.

The maintenance elevator is used when emergency repairs are required due to, for example, a failure of the carriage or a load collapse occurring during the operation of the crane, as well as for regular maintenance and checkup purposes. In such a case, an operator can get on the maintenance elevator as stopped at a position corresponding to the lowermost movement limit for the elevator. Then, the maintenance elevator is driven to move upward along the post and is brought to a stop at a desired level at which the gangway moving integrally with the elevator is positioned opposite to the carriage. Transferring of the operator from the maintenance elevator to the carriage and vice versa can be done in an easy and safe manner using the gangway as a foothold. At the end of the required operation, such as repairs, the maintenance elevator is lowered to the lowermost position, whereupon the operator lands on the ground to complete the required series of operations.

In one embodiment of the invention, there is provided a carriage side gangway adapted to be positioned in spaced apart opposed relation to the maintenance elevator side gangway.

According to this arrangement, the operator can utilize a pair of gangways as a foothold in transferring from the maintenance carriage to the carriage and vice versa so that such transfer can always be easily and safely done.

In a maintenance elevator-equipped handling apparatus of the present invention, the maintenance elevator is formed with a bay window portion projecting from an upper portion thereof at least at one side as viewed widthwise of the travelling body.

According to such arrangement, the maintenance elevator, when not in use, is at a stop at its lowermost movement limit close to the lower frame. Therefore, when it is necessary for the operator to walk alongside the maintenance elevator when the handling apparatus is at a stop, the operator can have easy passage without being subject to any obstruction due to the maintenance elevator, by passing under the bay window portion.

The operator, when he has got on the maintenance elevator, can manipulate the control panel while directing his visual attention forward, backward and sideways through the bay window portion. Therefore, the maintenance elevator can be so constructed as to be transversely small-sized, and compact and lightweight, and yet can provide a wider field of view by virtue of the bay window portion, thus enabling smooth and accurate operation for upward and downward movement.

In one embodiment of the invention, a control panel for the maintenance elevator is provided in the bay window portion of the maintenance elevator.

According to this arrangement, the operator is enabled to position the upper half of his body within the bay window portion thereby to manipulate, in a reasonable and easy manner, the control panel provided in the bay window portion for upward and downward movement of the maintenance elevator while directing his visual attention forward, backward and sideways.

In another embodiment of the invention, the bay window portion of the maintenance elevator projects outwardly relative to the post along which the maintenance elevator is vertically guided and widthwise of the travelling body.

According to this arrangement, the operator, when he has got on the maintenance elevator, has an easy access to the control panel for operation by positioning the upper half of his body within the bay-window portion, while directing his visual attention forward, backward and sideways and without his field of view being obstructed by the post or the like.

In a further embodiment of the invention, the maintenance elevator has a bay window portion formed at one side of the elevator as viewed widthwise of the travelling body and a gangway formed at the other side thereof.

According to this arrangement, by virtue of both the bay window portion and the gangway the maintenance elevator is transversely well balanced in weight-so that its upward and downward movement can always be effected in a stable manner. When it is necessary for the operator to walk along the other side of the maintenance elevator while the apparatus is not in operation, the operator can do so at ease and without being obstructed by the maintenance elevator, by walking on the gangway.

A maintenance elevator-equipped handling apparatus according to the invention includes a to-be-engaged element disposed along the post, and a vertical run drive means disposed on the maintenance elevator side for engagement with the to-be-engaged element.

According to such arrangement, when the vertical run drive means is actuated under panel control in the maintenance elevator, the vertical run drive means come into engagement with the to-be-engaged element linearly disposed along the post, so that the maintenance elevator can be moved upward along the post. For this purpose, the to-be-engaged element may be considerably short in total length, or may be of the same length as the post. Thus, the maintenance elevator is less subject to becoming bounced due to shocks caused upon the elevator being started or brought to a stop.

In another embodiment of the invention, the to-be-engaged element is comprised of a cord element running between the lower frame side and the upper end side of the post.

According to such arrangement, when the vertical run drive means is actuated, it goes into engagement with the cord element linearly arranged along the post so that the maintenance elevator can be moved upward and downward along the post. In this case, the fact that the cord element is considerably short in total length results in reduced elongation and also in reduced cost.

A maintenance elavator-equipped handling apparatus according to the invention includes a vertical run drive means disposed below a vertical movement path for the maintenance elevator and at either of the underside of the maintenance elevator or the upper surface of the lower frame, and a ladder provided in a lower portion of the post at one side.

According to such arrangement, the vertical run drive means is disposed in such a way that it projects from the underside of the maintenance elevator or from the upperside of the lower frame. This enables the operator to readily perform maintenance and checkup operations even when the maintenance elevator is at its lowermost position. The operator can get on and off the maintenance elevator at its lowermost position in an easy and safe way by using the ladder.

A maintenance elevator-equipped handling apparatus according to the invention comprises a vertical run drive means for the maintenance elevator including a cord element, a fall preventive device provided on the maintenance elevator, and an aluminum made guide rail provided on the post side for guiding the maintenance elevator, said guide rail having a pair of guide portions formed therewith for guiding the maintenance elevator and an engagement portion formed between the guide portions integrally therewith and adapted to be acted upon by the fall preventive device.

According to such arrangement, the aluminum made guide rail, including the pair of guide portions for the maintenance elevator and the engagement portion, can be easily and inexpensively fabricated and can be mounted (secured) to the post in a simple and easy manner. Since the engagement portion is provided at one location, it is only required that one set of fall preventive device be provided, which means simplified construction. The maintenance elevator is guided by a pair of guide portions for upward and downward movement, so that the elevator, in its vertical run, is prevented from jolting and is thus enabled to move upward and downward in a smooth manner. In the event that the cord element should become ruptured during vertical movement of the maintenance elevator, the fall preventive device will act on the engagement portion to prevent the maintenance elevator from falling.

In a preferred embodiment, the engagement portion defines two flat abutment surfaces, right and left, and the fall preventive device includes a pair of pads respectively positioned opposite to the abutment surfaces and resiliently urged toward the abutment surfaces, the pads each having a flat holding surface, there being provided an interlocking means for moving the pads away from the abutment surfaces against the resilient urging force when a suspension tension is being applied to the cord element.

According to this arrangement, during vertical movement of the maintenance elevator, a suspension tension acts upon the cord element and therefore the fall preventive device is in an inoperative state in which the two pads are moved away from the abutment surfaces through the interlocking means. Therefore, the maintenance elevator can be moved upward and downward in a smooth manner and without difficulty. In the event of the cord element becoming fractured during vertical movement of the maintenance elevator, the suspension tension acting on the cord element is released and accordingly the pads are caused to move toward the engagement portion under the resilient urging force applied to the pads so that the flat holding surfaces of the pads come into pressure contact with the abutment surfaces. In this way, the fall preventive device acts upon the engagement portion to prevent the maintenance elevator from falling. Such pressure contact between flat surfaces will minimize possible mars and damages that may otherwise be caused to the guide rails and/or pads.

DESCRIPTION OF THE PREFERRED EMBODIMENTS

One embodiment of the present invention will now be described with reference to FIGS. 1 through 8.

Figure 1:
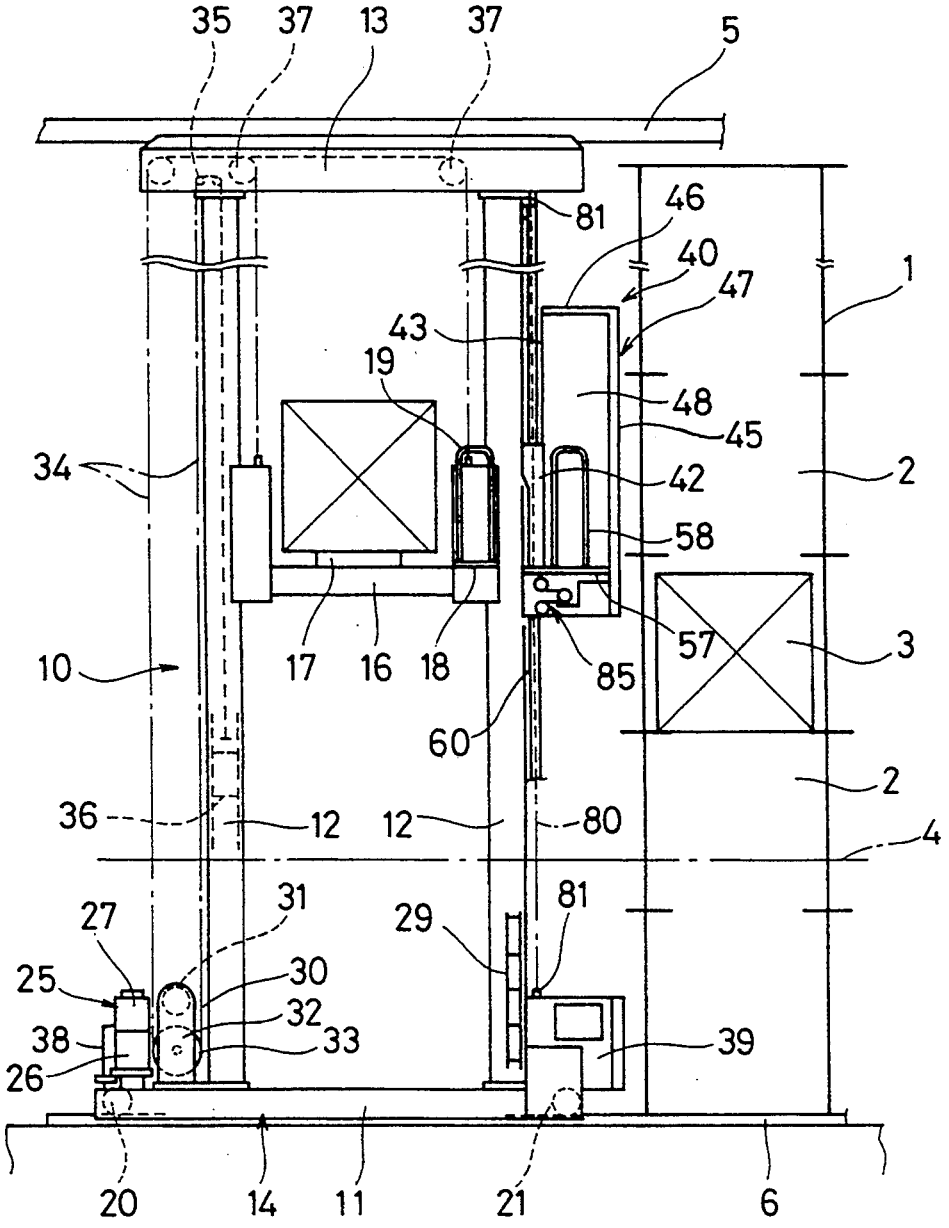
FIG. 1 illustrates one embodiment of the present invention and is a partially cutaway side view of an automatic warehousing facility having a maintenance-elevator-equipped handling apparatus employed therein.
Figure 2:
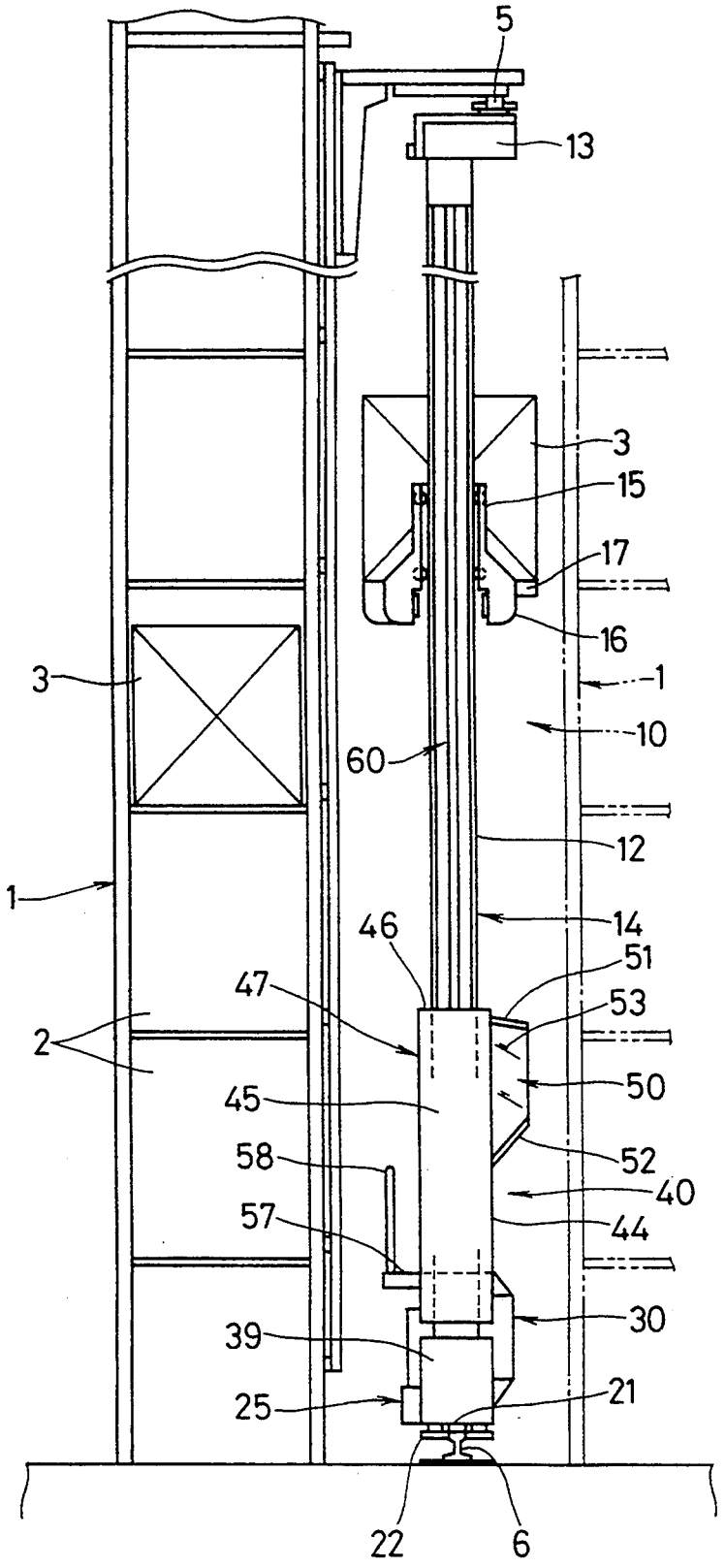
FIG. 2 is a partially cutaway view in front elevation showing the automatic warehousing facility using the maintenance-elevator-equipped handling apparatus.
Figure 3:
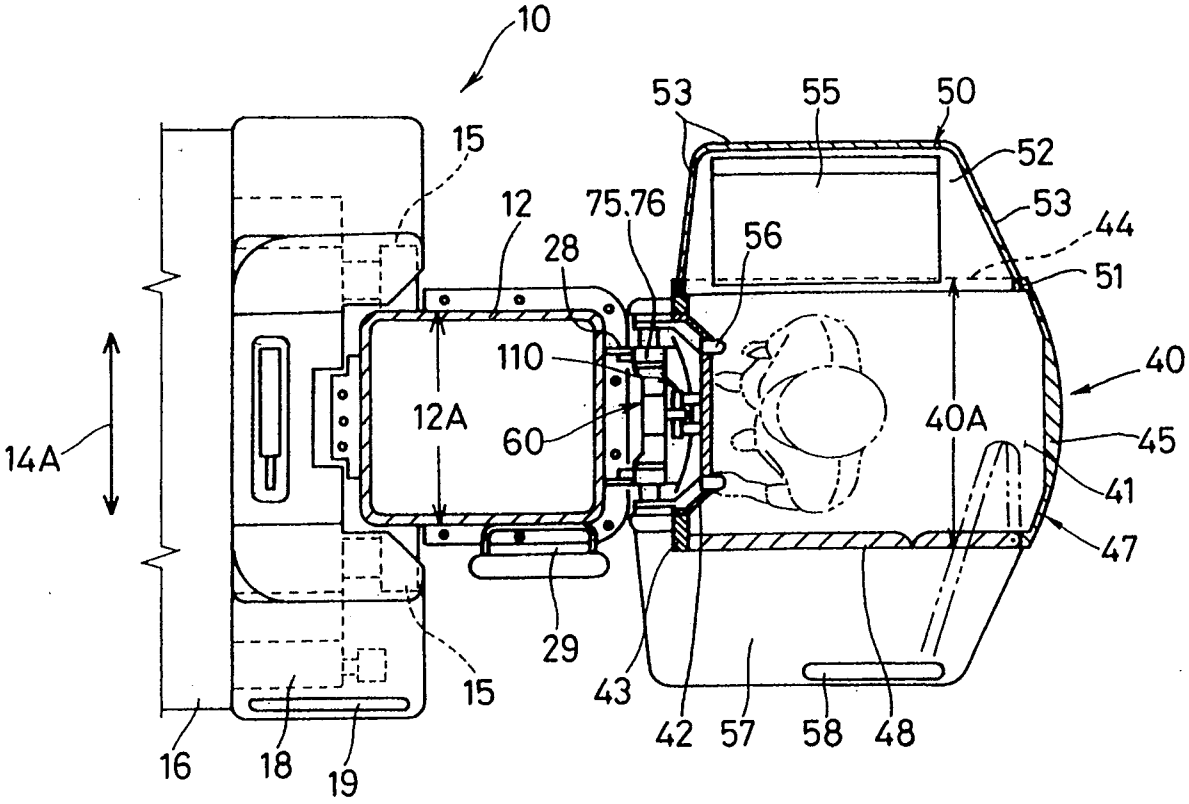
FIG. 3 is a cross-sectional plan view of a maintenance elevator portion of the maintenance-elevator-equipped handling apparatus.
Figure 4:
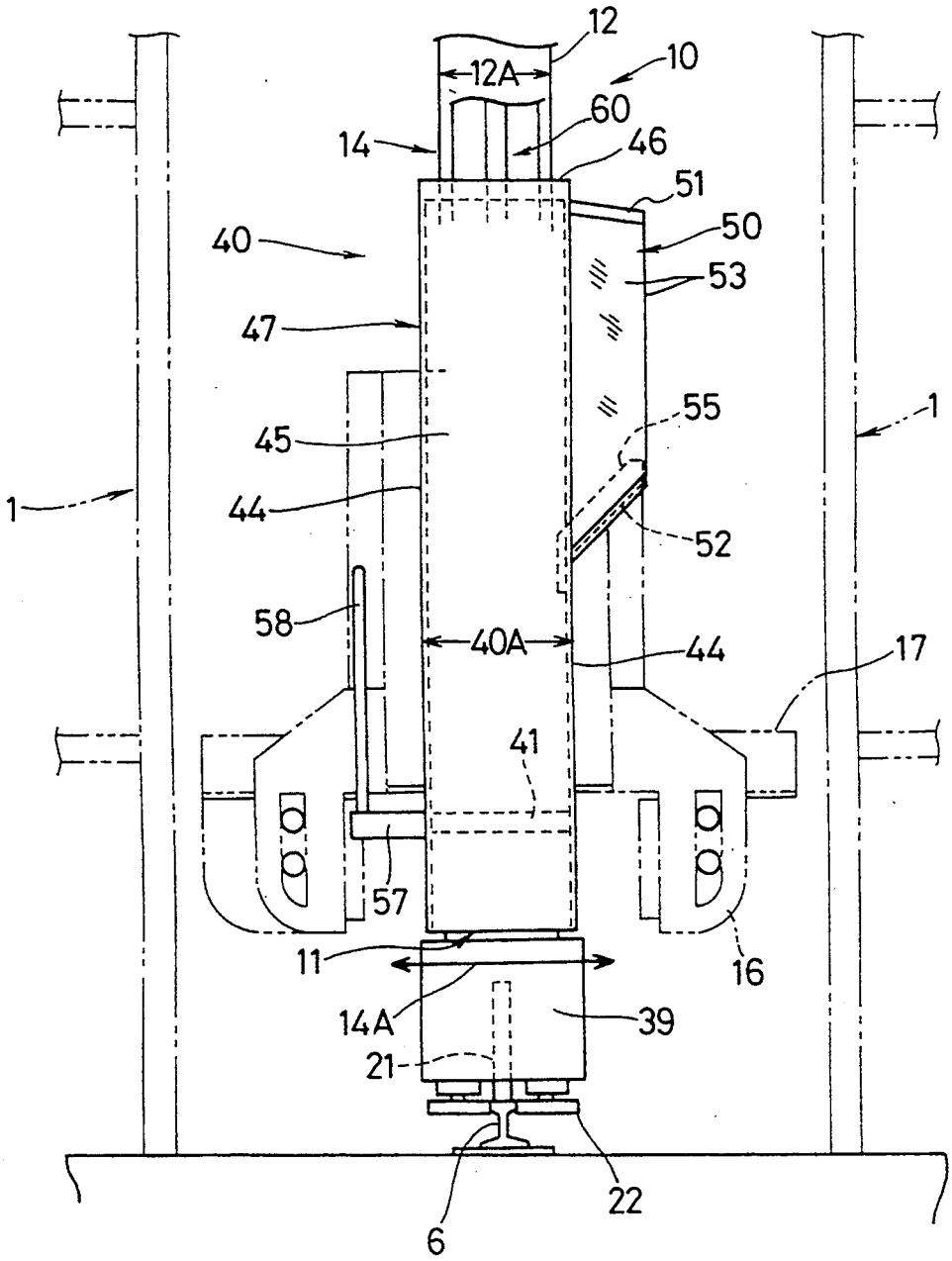
FIG. 4 is a front view of the maintenance elevator portion of the maintenance-elevator-equipped handling apparatus.
Figure 5:
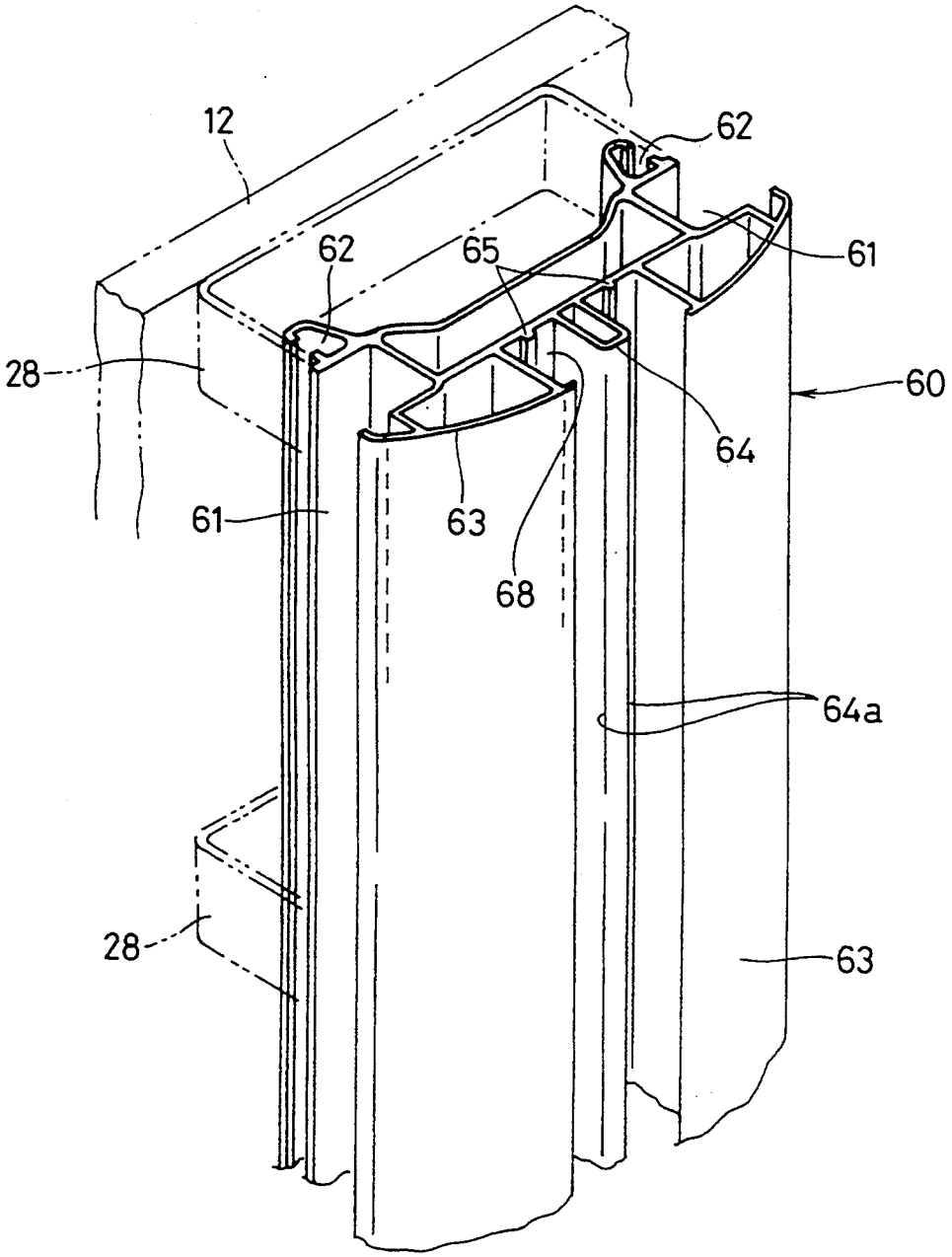
FIG. 5 is a perspective view of a guide rail for the maintenance elevator.
Figure 6:
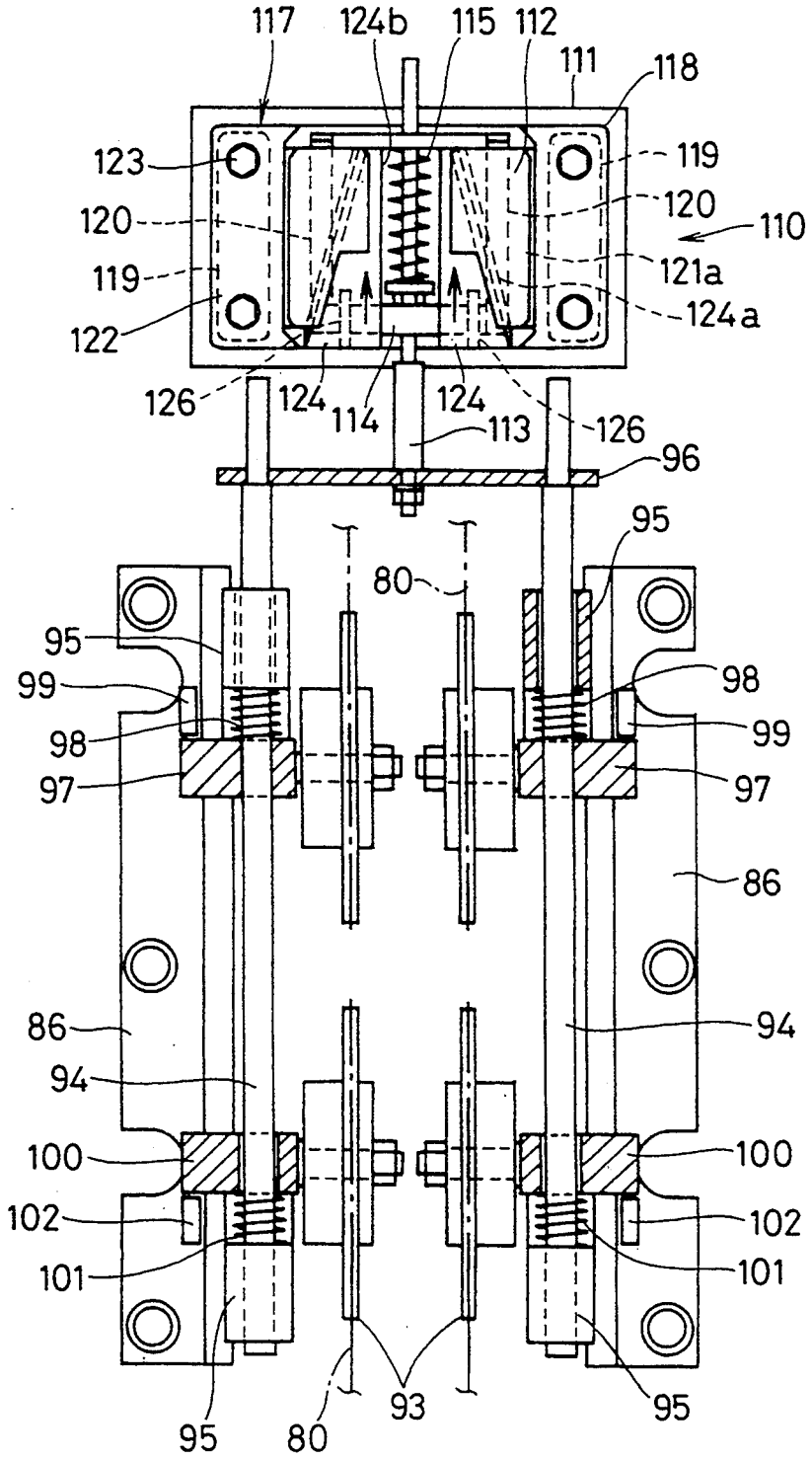
FIG. 6 is a partially cutaway front view of a vertical guide portion for the maintenance-elevator-equipped handling apparatus.
Figure 7:
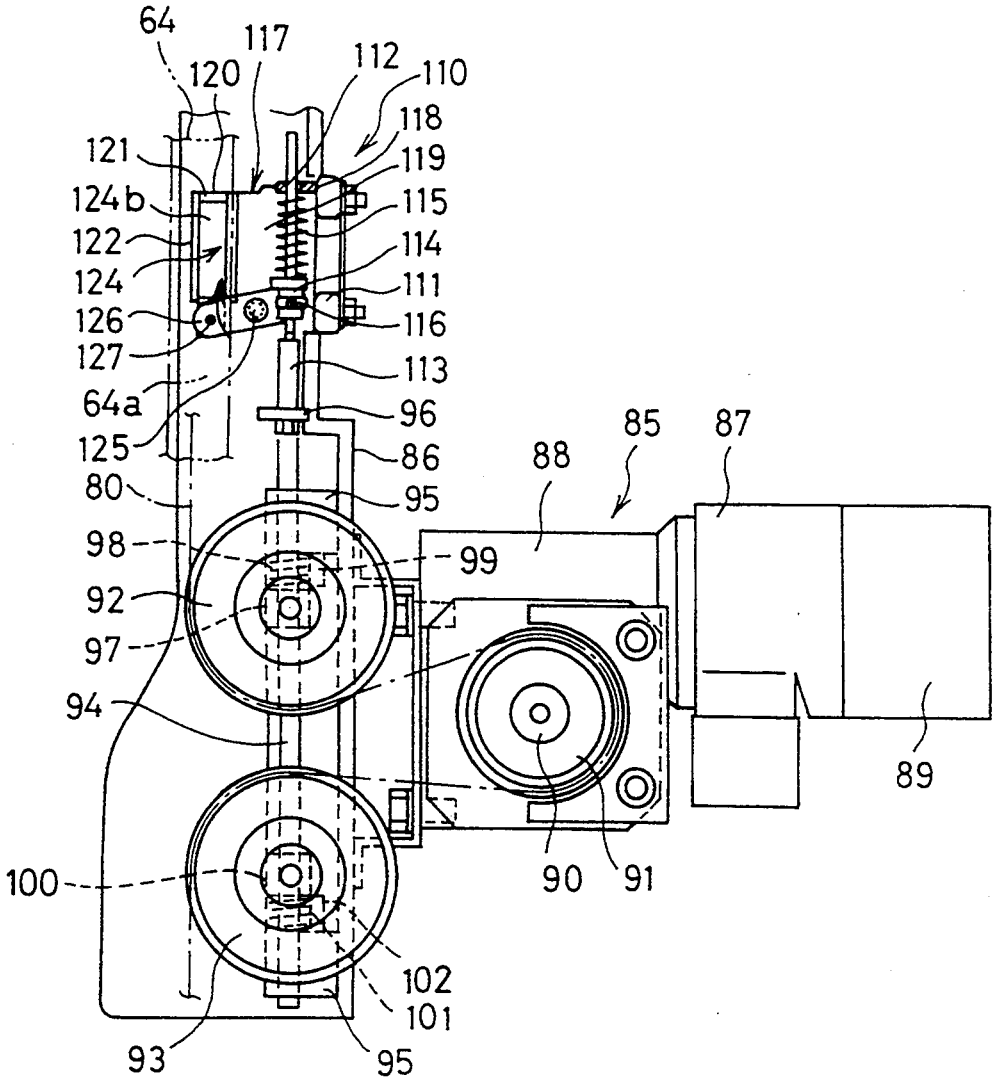
FIG. 7 is a partially cutaway side view of the vertical guide portion.
Figure 8:
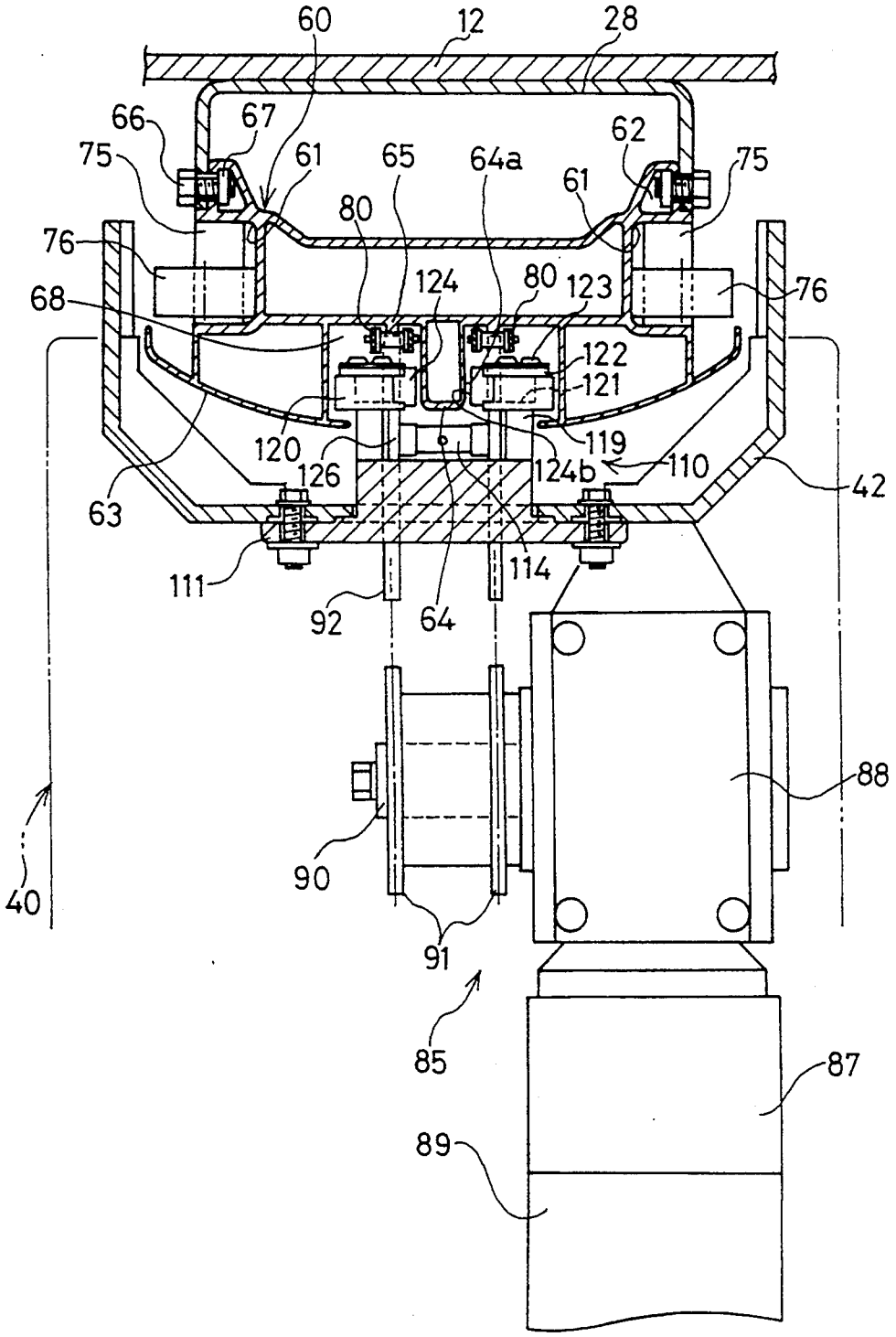
FIG. 8 is a cross-sectional plan view of the vertical guide portion.

In FIGS. 1 and 2, a framework-like rack 1 defines pluralities of vertically and horizontally spaced apart storage sections 2, each of the storage sections 2 having a cross arm for supporting a load 3 (directly or via a pallet). A pair of such racks 1 are arranged in parallel across a passageway. In the passageway there is disposed a maintenance elevator-equipped handling apparatus 10 for movement on a predetermined track 4 extending along the racks 1.

The maintenance elevator-equipped handling apparatus 10 has a travelling body 14 comprising a lower frame 11, a pair of posts 12, front and rear, in the form of square pipes (or round pipes) extending vertically from the lower frame 11, and an upper frame 13 interconnecting the upper ends of the posts 12. A carriage 16 is disposed between opposed inner sides of the posts 12 (as viewed in the direction of movement of the travelling body), the carriage 16 being guided for movement upward and downward through guide rollers 15 guided along opposite outer sides of the respective posts 12. On the carriage 16 there is disposed a handling element (fork element) 17 which is retractably extendable relative to each storage section 2. The upper frame 13 has guide means guided by a ceiling rail 5.

The lower frame 11 carries at one end a drive wheel 20 movable in rolling contact with a floor rail 6, and at the other end a driven wheel 21. A pair of guide wheels 22, right and left, are free-rotatably provided at both ends of the lower frame 11, the guide wheels 22 being guided along sides of the floor rail 6. A horizontal run drive unit 25 mounted to one end of the lower frame 11 includes a reduction gear 26 geared to the drive wheel 20, and a horizontal run drive means (flange-type brake-equipped motor or the like) 27 geared to the reduction gear 26.

A vertical run drive unit 30 is mounted to one end of the lower frame 11, the vertical drive unit 30 being geared to the carriage 16. The vertical drive unit 30 comprises vertical run drive means (a motor and the like) 31 and a reduction gear 32. The vertical drive unit BO carries a drive wheel 33 which is geared to an output shaft extending from the reduction gear 32. Two non-endless cord elements (ropes, chains or the like) 34 are trained about the drive wheel 33, one end of each cord element 32 being introduced into one of the posts 12 via first guide wheels 35 disposed in the upper frame 13 for being connected to a counter weight 36 housed in the one post 12. The other end of each cord element 34 is connected to an upper portion of the carriage 16 via second guide wheels 37 disposed in the upper frame 13.

At one end of the lower frame 11 there is provided a power unit 38 for controlling the horizontal run drive unit 25 and vertical run drive unit 30. A control unit 39 for controlling individual operative portions of the maintenance elevator-equipped handling apparatus 10 is provided at the other end of the lower frame 11. The control unit 39 has its control surface oriented sideways.

In FIGS. 1 through 4, there is shown a maintenance elevator 40 disposed at the outer side (rear side) of the other post 12 as viewed in the direction of movement of the travelling body which is upward and downward movably provided for use in maintenance and checking and for emergency use. The maintenance elevator 40 has a vertically long, rectangular box-shaped body 47 comprising a bottom plate 41, a bracket 42 serving as a guide for upward and downward movement which extends upwardly from the front side of the bottom plate 41, a front plate 43 extending upward from the bracket 42, a side plate 44 extending upward from the right side of the bottom plate 41 and having a side edge integrally joined with both the bracket 42 and the front plate 43, a rear plate 45 extending upward from the rear side of the bottom plate 41 and having a side edge integrally joined with the side plate 44, and a ceiling plate 46 integrally joined with upper edges of the front plate 43, side plate 44 and rear plate 45.

The maintenance elevator 40 has a bay window-like portion 50 projecting outward from an upper part of its body portion at one side thereof as viewed widthwise (14A) of the travelling body 14. The maintenance elevator 40 has its width or transverse length bOA designed to be equal to or slightly larger than the transverse length 12A of each post 12, except the bay window-like portion 50.

The bay window-like portion 50 comprises a frame 51 integral with the side plate 44 of the body 47, the frame 51 including an inclined support plate 52 which is sloped outwardly upward. The bay window-like portion 50 has front, rear and outer wall portions formed of a transparent plate 53 which are mounted to the frame 51. A control board 55 is provided on the inclined support plate 52 in the maintenance elevator 40. A handle portion 56 is provided in the bracket At the other side of the maintenance elevator 40, as viewed widthwise (14A) of the travelling body, there is provided a freely openable and closable door member 48 of the foldable type. A maintenance elevator side gangway 57, integral with the bottom plate 41, extends forwardly from the other side of the door member 48 at its closed position. A safety fence 58 is provided extending along an outer edge portion of the maintenance elevator side gangway 57. A carriage side gangway 18 extends from the other side of the carriage 16 in such a way as to enable the maintenance elevator side ganway 57 to be positioned in spaced apart opposed relation to the carriage side gangway 18. A safety fence 19 is provided extending along an outer side edge of the carriage side gangway 18. A ladder 29 is provided between the two gangways 18 and 57 and at the lower end of the post 12.

The maintenance elevator 40 is upward and downward movably supported on a guide rail 60 mounted to the outer side of the post 12 via the earlier mentioned bracket 42. As FIGS. 1 and 5 to 8 show, the guide rail 60 has a pattern rail structure formed by aluminum extrusion and comprises guide portions 61 of a laterally outwardly opening U-groove shape for the maintenance elevator formed at opposite sides, coupling-purpose dovetail grooves 62 open laterally outwardly which are formed in inwardly spaced parallel relation to the guide portions 61, and outwardly convexed arcuate cover plate portions 63 formed in spaced parallel relation externally of the guide portions 61, there being formed an outwardly opening U groove portion 68 intermediate the cover plate portions 63.

In the U groove portion 68 there is formed integrally therewith an outwardly projecting engagement portion 62 of a rectangular pipe configuration. The engagement portion 64 defines flat abutment faces 64*a* on opposite sides thereof. At both sides of the engagement portion 64 there are formed outwardly protruding chain guide portions 65 integrally therewith.

The guide rail 60 is fixedly secured by and between coupling members 28 attached to the post 12 on the outer side thereof at a plurality of vertically spaced locations. Each of the coupling members 28 is gantry shaped in plan view and its legs have free ends brought in abutment against coupling-purpose dovetail grooves 62 from the outer side thereof, with bolts 66 passed through the free ends of the legs from the outer side, the bolts 66 being brought into thread engagement with nut elements 67 positioned within the coupling dovetail grooves 62.

The maintenance elevator 40 is vertically movably supported on the guide rail 60 through longitudinal regulation rollers 75 and lateral regulation rollers 76 which are arranged in the bracket 42. The bracket 42 has a gantry shaped cross-sectional configuration opening toward the post 12 such that to free ends of its two legs are freely rotatably mounted the regulation rollers 75, 76 which engage the guide portions 61 for being thereby supported and guided.

In order to enable the maintenance elevator 40 to be upwardly and downwardly moved along the guide rail 60, a pair of chains, right and left (an example of the to-be-engage element and also of the cord element) 80 are trained between the lower frame 11 and the upper frame 13, opposite ends of the chains 80 being respectively connected to the lower frame 11 and the upper frame 13 through coupling elements 81. For this purpose, the chains 80 are abuttable against the chain guide portions 65 from outer side. On the maintenance elevator 40 side there is provided vertical run drive means 85 operative to engage the chains 80.

On the underside of bottom plate 41 of the body 47 at the forward end there is provided a bracket 86 in which is disposed the vertical run drive means 85. The vertical run drive means 85 comprises a motor 87, a reduction gear 88 and a brake means 89 geared to the the motor 87 in longitudinally spaced apart relation, a pair of toothed drive wheels 91, right and left, mounted to an output shaft 90 of the reduction gear 88, and pairs of vertically spaced apart freely rotatable toothed wheels 92, 93, right and left, arranged forwardly of the toothed drive wheels 91.

A pair of rods 94, right and left, are upward and downward movably disposed in the bracket 86 via guide members 95, the rods 94 being integrally connected at top ends thereof by a jumper plate 96. Upper shaft members 97 are fixed to upper portions of the respective rods 94 through a pin or the like, with a freely rotatable upper toothed wheel 92 mounted to an upper portion of each of the upper shaft members 97. Above each upper shaft member 97 there is provided an upper compression coil spring 98 which urges the respective rod 94 downward, there being also provided an upper detecting device (a limit switch) for detecting the respective upper shaft member 97 when moved upward against the upper compression coil spring 98.

Lower shaft members 100 are fitted on the lower portions of the respective rods 94 for free vertical movement relative to each other, with lower freely rotatable toother wheels 93 mounted to the lower shaft members 100. Below the respective lower shaft members 100 are disposed lower compression coil springs 101 which urge the respective lower shaft members 100 upward, there being also provided lower detecting devices (limit switches) 102 for detecting the respective lower shaft members 100 when moved downward against the lower compression coil springs 101.

The chains 80 are trained on respective freely rotatable upper toothed wheels 92 from the front side for engagement therewith and, in turn, trained on respective toothed drive wheels 91 from the rear side for engagement therewith, being then trained on respective freely rotatable lower toothed wheels 93 from the front side for engagement.

On the bracket 42 side of the maintenance elevator 40 there is provided a fall preventive device 110 operative to act on the engagement portion 64. The fall preventive device 110 is disposed above the freely rotatable toothed wheels 92, 93 and has a box frame-like body 111 integral with the bracket 42. The body 111 is formed with a vertically extending through-hole 112 into which is inserted from below an upstanding shaft 113 connected to the jumper plate 96.

A block 114 is fixedly fitted over a median portion of the shaft 113 and, above the block 114, there is disposed a compression coil spring 115 urging the shaft 113 downward via the block 114. The block 114 has a transversely extending horizontal pin In the body 111 there is provided a case member 117 which comprises a vertically rectangular plate-shaped base portion 118, a pair of arm portions, right and left, 119 extending from the base portion 118 to the engagement portion 64, and pad-receiving portions 120 fixed to free ends of the arm portions 119. The pad receiving portions 120 have stepped portions 121 which are open at their opposed sides as well as at outer sides. The opposed surfaces of the stepped portions 121 define inclined guide faces 121*a* which come closer to each other toward their upper ends.

A cover member 122 for closing an outer open portion of each of the stepped portions 121 is provided which is fixed to the respective pad receiving portion 120 via bolts 123. Pads 124 disposed within the respective stepped portions 121 are of a wedge-like configuration and have inclined surfaces which serve as inclined guided surfaces 124*a* for abutment against the respective inclined guide faces 121*a* of the stepped portions 121. Parallel opposed surfaces of the pads are formed as flat holding surfaces 124*b*.

A pair of links, right and left, 126 are vertically pivotably mounted between the arm portions 119 of the case member 117. The links 126 are attached at their median portions to support shafts 125, inner ends of the links 126 being respectively connected to the horizontal pins 116 of the block 114 for relative pivotal movement. Outer ends of the links 126 are connected to the lower portions of the respective pads 124 through lateral pins 127 for relative pivotal movement.

As earlier described, chains 80 are trained about freely rotatable upper toothed wheels 92, whereby rods 94 are moved upward against the upper compression coil springs 98 thereby to urge the shafts 113 upward against the compression coil springs 115 via the jumber plate 96. The upward movement of the shafts 113 results in downward movement of the pads 124 via links 126 and the like. Thus, the foregoing elements 94 to 98, 100, 101, 113 to 116, and 125 to 127 constitute interlocking means for moving the two pads 124 away from each other against resilient urging force when a suspension tension is acting upon the chains 80.

In the above described embodiment, the maintenance elevator equipped handling apparatus 10 perform a combination of operations including actuating the horizontal run drive unit 25 to horizontally move the travelling body 14, actuating the vertical run drive unit 30 to move the carriage 16 upward and downward, and actuating the handling element 17 to perform forking movement, through operating commands issued by manipulating the control unit 39, so that delivery of load 3 to and from a target storage portion 2 of the rack 1 can be carried out.

During such operations, the maintenance elevator 40 is held stationary at its lowermost position close to the lower frame 11. Therefore, when it is necessary for the operator to walk for access into the predetermined path 4 during such time of rest, the operator can, at one side of the maintenance elevator equipped handling apparatus 10, pass under the bay window portion 50 for entry into the predetermined path without any obstruction due to the maintenance elevator 40, while at the other side of the apparatus 10 the operator can walk on the maintenance elevator side gangway 57 for entry into the predetermined path without any obstruction from the maintenance elevator 40.

The maintenance elevator 40 is used in carrying out emergency repairs as required, for example, when some trouble has occurred with the carriage 16 or a load collapse has occurred, as well as for purposes of carrying out regular maintenance and checkup. A ground-side operator can get on the maintenance elevator side gangway 57 by utilizing the ladder 29 and, from the gangway 57 side, he can open the door member 48 to get on the maintenance elevator and manipulate the control panel 55.

In that case, necessary operation is carried out in such a manner that the operator in the maintenance elevator 40 positions his upper body portion in the bay window portion 50 to manipulate the control panel disposed in a lower part of the bay window portion 50 while looking forward, backward and/or sideways through the transparent plate 53 and without his view being obstructed by the post 12 and the like. If the operator is forced to assume an unstable posture, he may control the control panel 55 by right hand, for example, while gripping the handle portion 56 by left hand.

In this way, the operator can manipulate the control panel 55 so that the motor 87 of the vertical run drive means 85 can be driven forward and reverse, whereby toothed drive wheels 91 can be rotated forward and rearward through the reduction gear 88 and output shaft 90. Thus, the drive wheels 91 which are in constant engagement with the chains 80 trained linearly (in a rack fashion) between the upper and lower frames 13 and 11 are driven into forced rotation, so that the maintenance elevator 40 can be moved upward along the guide rail 60. For purposes of taking corrective action in case of load collapse, for example, the maintenance elevator 40 can be brought to a stop at a position opposite to the carriage 16. In this case, the maintenance elevator side gangway 57 is positioned opposite to the carriage side gangway 18 at an even level.

During upward and downward movement of the maintenance elevator 40, a suspension tension is acting upon the chains 80. The chain 80 secured at its upper end to the upper frame 13 by the coupling element 81 is trained on the toothed drive wheel 91 for engagement therewith, so that the portion of the chain 80 which is positioned above the freely rotatable toothed wheel 92 is subject to a suspension tension. Under this suspension tension the rods 94 are moved upward against the upper compression coil spring 115 via the upper free-rotatable toothed wheel 92 and upper shaft element 97.

As a consequence, the shaft 113 is moved upward against the force of the compression coil spring 115 via the jumper plate 96. At same time, the block 114 which is integral with the shaft 113 is moved upward against the force of the compression coil spring 115. Thus, the links 126 are caused to pivot about the support shaft 125 to lower the pads 124. The descent of the pads 124 produces the effect of a wedge removal so that the holding surfaces **124*b* are moved away from the abutment surfaces 64*a*, the fall preventive device 110 being thus rendered inoperative. Further, because of the fact that the regulation rollers 75, 76 are guided by the guide portions 61, there is no possible jolting. With these characteristic features, the maintenance elevator 40** can be smoothly and conveniently operated for upward and downward movement.

The upper detecting devices 99 become turned on in response to the ascent of the upper shaft members 97, and likewise the lower detecting devices 102 become turned on in response to the descent of the lower shaft members 100. When the respective detecting devices 99, 102 are in sensing operation in this way, there is no emergency situation and, therefore, the vertical run drive means 85 perform their normal operation and the fall preventing device 110 is held inoperative.

As stated above, for purposes of carrying out required repairs or a maintenance and checkup operation, the maintenance elevator 40 is caused to stop upward movement and the brake means 89 is operated; and then the operator opens the door member 48 and moves onto the maintenance elevator side gangway 57. Protected by the safety fences 19, 58, the operator can transfer from the maintenance elevator side gangway 57 to the carriage side gangway 18 while having a hold of the safety fence 19, 58, in order to carry out the required repairs or maintenance and checkup.

Upon completion of the required operation, the operator can return from the carriage 16 to the maintenance elevator 40 by utilizing the gangways 18, 57. The maintenance elevator 40 is then lowered to its lowermost position and the operator lands on the ground using the ladder 29, whereupon a series of operations using the maintenance elevator 40 is ended.

During upward or downward movement of the maintenance elevator 40, if one chain 80 becomes fractured or stretched, the brake device 89 of the vertical run drive means 85 operates in response to such situation. The suspension tension acting upon the freely rotatable toothed wheels 92, 93 about which the respective chain 80 is trained is released, whereupon the shaft members 97, 100 are shifted under the elastic force of the compression coil springs 98, 101 to render the detecting devices 99, 102 inoperative. Accordingly, the brake device 89 of the vertical run drive means 85 is automatically actuated to stop subsequent vertical movement of the maintenance elevator 40, alarming the operator of the situation.

During upward or downward movement of the maintenance elevator 40, if both of the chains 80 become fractured, the fall preventive device 110 is automatically actuated, simultaneously with the functioning of the above described brake device, to prevent the maintenance elevator 40 from falling. More specifically, when the chains become fractured, the suspension tension acting upon the upper free-rotatable wheels 92 is released and accordingly various elements including rods 92, jumper plate 96, shafts 113, and block 114 are subjected to relative downward movement with respect to the body 111 under the resilient force of the compression coil springs 98, 115. As a result, the links 126 are pivoted about the support shaft 125 (as indicated by arrow A in FIG. 7) to elevate the pads 124 (as indicated by arrow B in FIG. 6).

As the pads 124 move upward, the inclined guided surfaces 124*a* are guided to the inclined guide faces 121*a* in a wedging fashion, so that holding surfaces 124*b* move toward the engagement portion 64 in such a manner that flat surfaces go into abutment against each other, whereupon the fall preventive device 110 goes into operation. Thus, the maintenance elevator 40 is prevented from falling due to the fracture of the chains 80.

It is to be noted that in the case of the chains 80 becoming fractured at a location lower than the toothed drive wheel 91, only the brake function works and the fall preventive device 110 does not operate.

In the above described embodiment, the control panel 55 is provided in a lower part of the bay window portion. Alternatively, however, the control panel 55 may be disposed at a different location within the maintenance elevator 40, or in an upper part or side portion of the bay window portion 50. In the foregoing embodiment, the bay window portion 50 is provided at one side of the maintenance elevator 40. However, in another embodiment of the invention, the bay window portion 50 may be provided at the other side (door member 48 side) or at both sides of the maintenance elevator 40.

In the foregoing embodiment, the to-be-engaged element is in the form of a cord member (chain 80) by way of example. As an alternative, it may be racks vertically arranged along the post 12 at the other side thereof, in which case pinions geared to the output shaft of the vertical run drive means 85 will engage the racks.

In the foregoing embodiment, the vertical run drive means 85 is disposed in such a manner that it projects outwardly from the underside of the maintenance elevator 40, so that a maintenance and checkup operation for the vertical run drive means 85 can be carried out in such a condition that the maintenance elevator 40 is held stationary at its lowered position at which the vertical run drive means 85 is located close to the upper surface of the lower frame 11. The outwardly projecting vertical run drive means 85 may be provided with an openable/closable cover or a removable cover as required.

The fall preventive device 100 in the foregoing embodiment is such that flat holding surfaces 122*b* of the pads 122 are brought in abutment against the flat abutment surfaces 66*a* thereby to prevent the maintenance elevator 40 from falling. As an alternative, however, the fall preventive device may be such one as utilizing cam-form brake elements as employed in the prior art.

In the foregoing embodiment, the engagement portion 64 is formed integrally with the guide rail 60. However, the abutment portion 64 may be formed separetely from the guide rail 60, thus formed abutment portion 64 being disposed on the post 12 side.

In the above described embodiment, the fall preventive device 100, as a vertically movable element, is disposed between the maintenance elevator 40 and the post 12. As an alternative, a fall preventive device 100 may be provided between the post 12 and the carriage 16.

Figure 9:
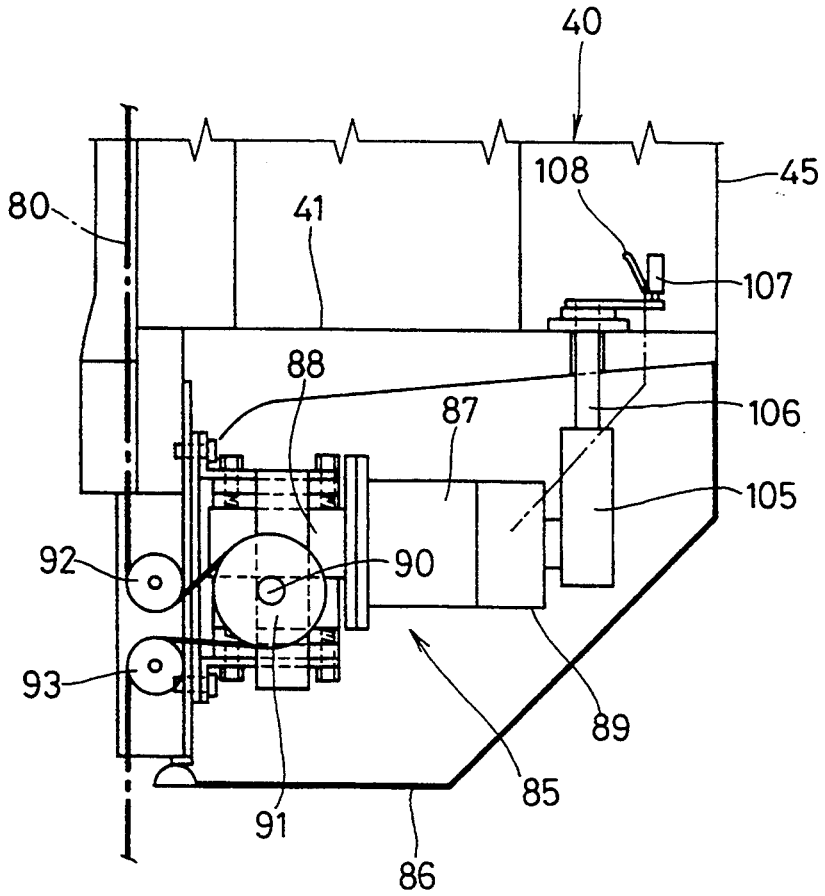
FIG. 9 is a partially cutaway side view of an elevator portion of a maintenance-elevator-equipped handling apparatus which represents another embodiment of the invention.
Figure 10:
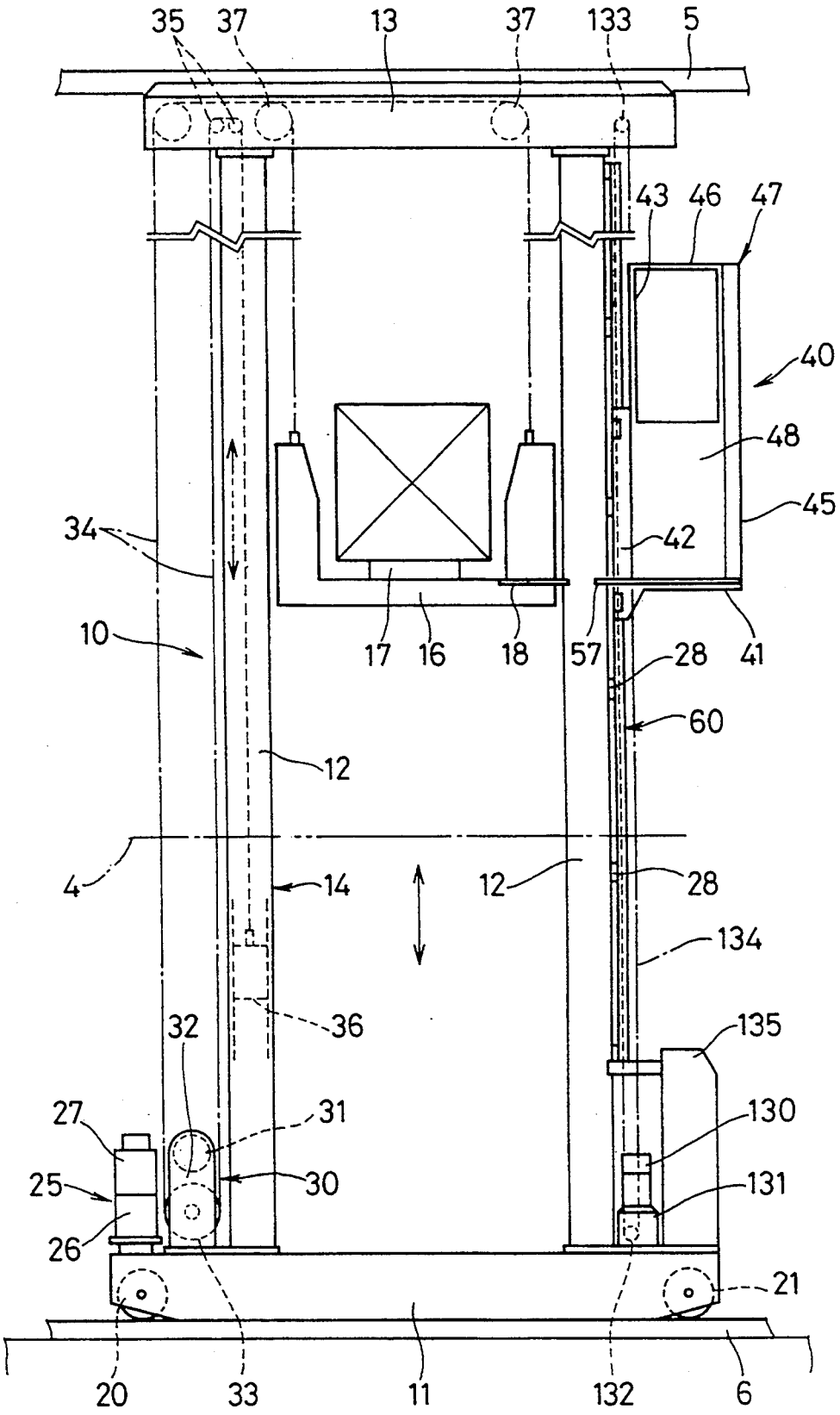
FIG. 10 is a partially cutaway side view of a maintenance-elevator-equipped handling apparatus which represents a further embodiment of the invention.
Figure 11:
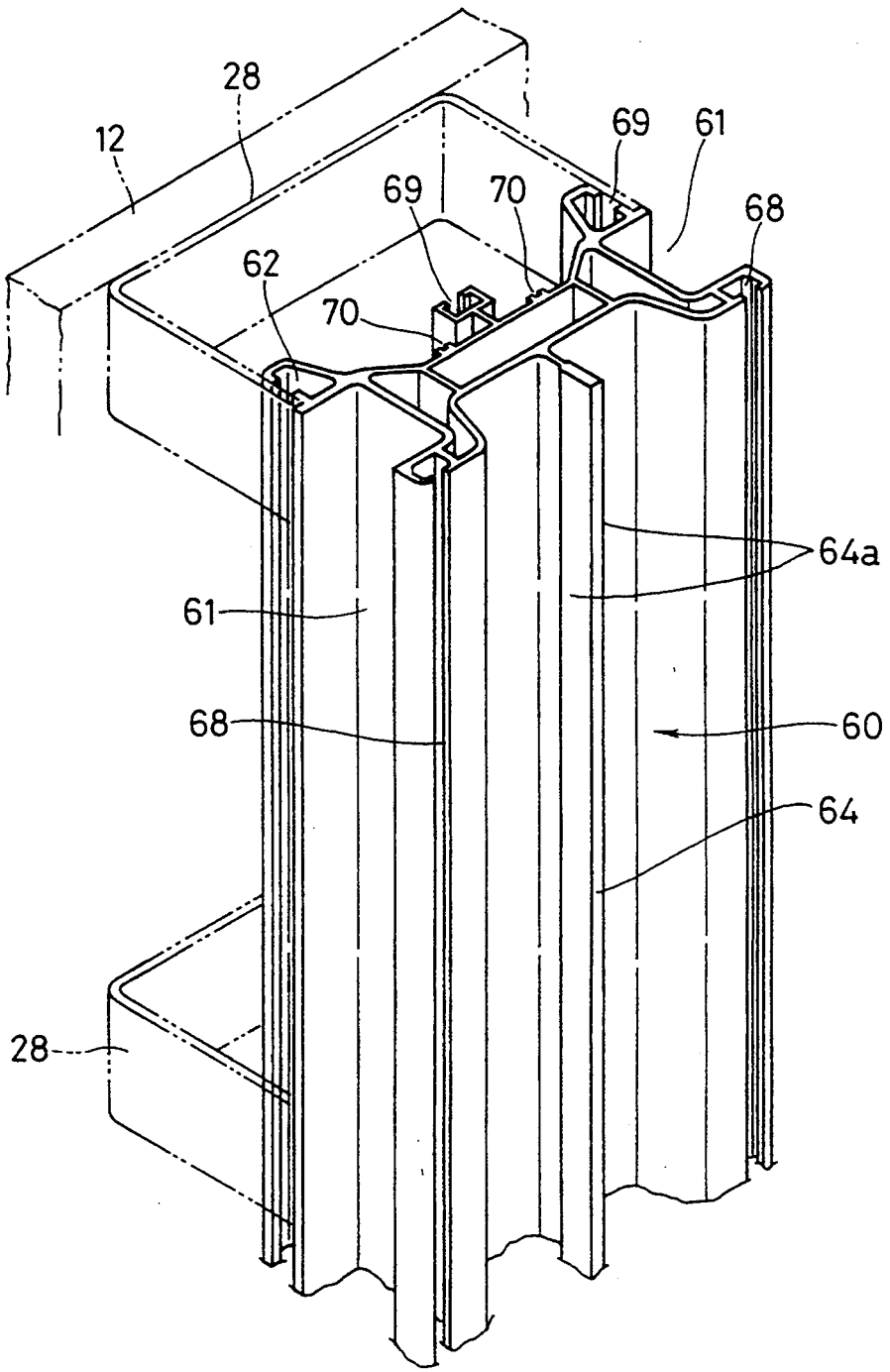
FIG. 11 is a perspective view of a guide rail for the maintenance elevator.
Figure 12:
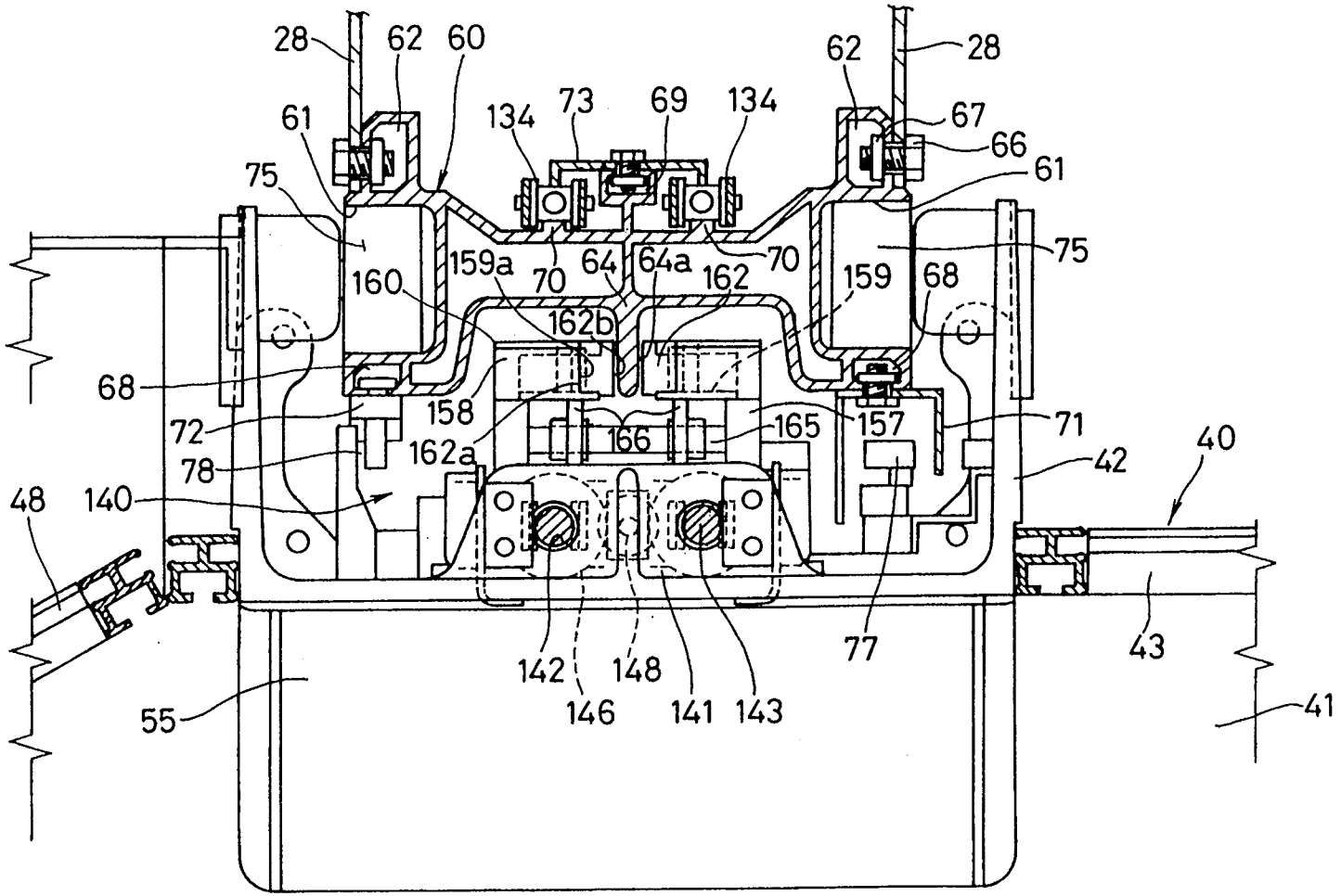
FIG. 12 is a cross-sectional plan view of a fall-preventive device portion of the apparatus.
Figure 13:
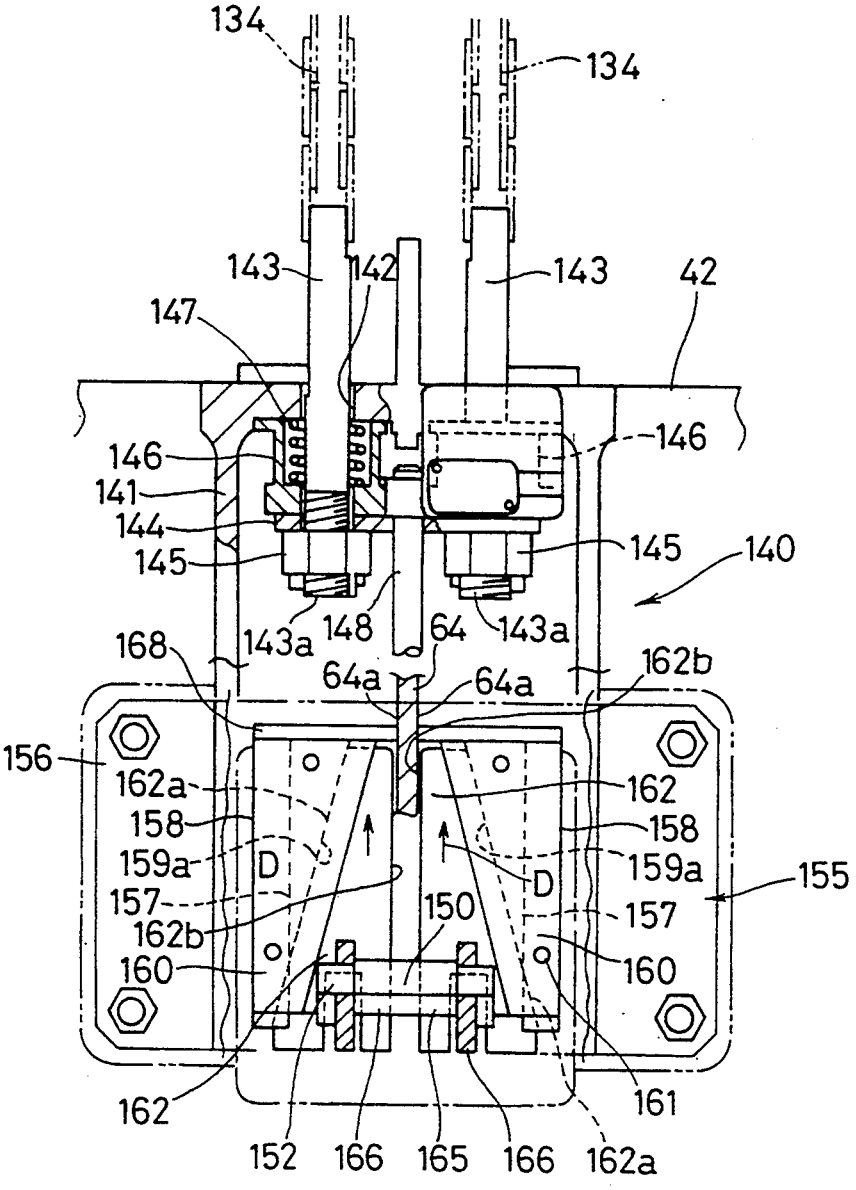
FIG. 13 is a partially cutaway front view of the fall-preventive device portion.
Figure 14:
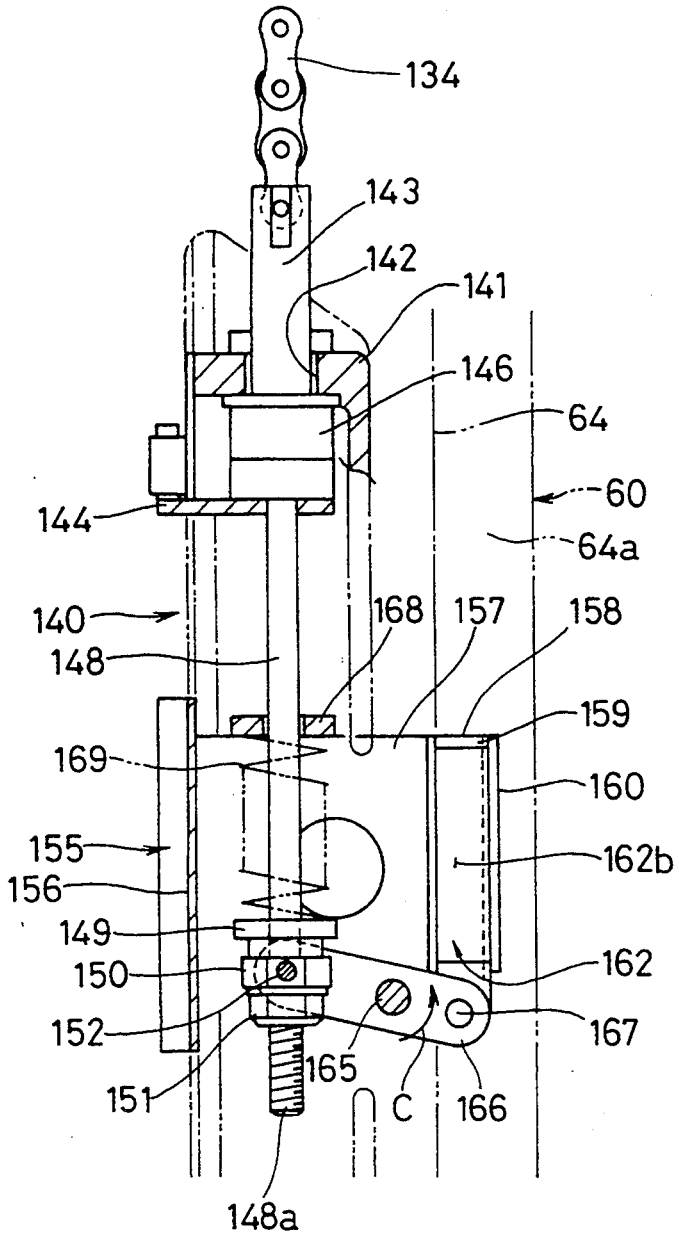
FIG. 14 is a partially cutaway side view of the fall-preventive device portion.

FIG. 9 shows another embodiment of the present invention. A control shaft 106 is geared to the brake device 89 via a differential device 105. The control shaft 106 projects into the body 47 and has a handle 107 provided on its projection for control turning. The handle 107 portion is provided with a lever 108 for releasing the brake device.

According to this embodiment, in case that the maintenance elevator 40, when in use, stops moving in an upper or intermediate portion of the vertical path for the maintenance elevator 40 due to, for example, some trouble with the electric system or power failure, the operator can lower the maintenance elevator 40 by manual control within the body 47. The operator, while holding the handle 107, can control the lever 108 to release the brake device 89. Then, the operator control the handle 107 so that the rotation effort is transmitted to the toothed drive wheel 91, whereby the maintenance elevator 40 can be lowered to its lowermost position.

Such arrangement for lowering the maintenance elevator 40 by manual control eliminates the need for such emergency escape ladder as has been used in the prior art. Further, in order to insure good safety during manual downward movement, it is arranged that even when hand slips off the handle 107 the lever 108 is released so that the brake device 89 is automatically engaged.

FIGS. 10 to 14 illustrate still another embodiment of the invention. The maintenance elevator side gangway 57 and the carriage side gangway 18 project toward each other in such a way as to reduce the gap therebetween to a minimum. The guide rail 60 for guiding the maintenance elevator 40 for upward and downward movement is made in a pattern rail form by aluminum extrusion and is formed with outside mounting dovetail grooves 68 located in spaced parallel relation at outer side of the respective guide portions 61, the dovetail grooves 68 being outwardly open.

The guide rail 60 is also formed with an inside mounting dovetail groove 69 located between two coupling dovetail grooves 62 and open inward. At both sides of the inner mounting dovetail groove 69 are formed inwardly protruding chain guide portions 70, and between the two guide portions 61 is located an outwardly projecting engagement portion 64 of a plate configuration which is integrally formed with the guide portions 61.

To the outside mounting dovetail grooves 68 are vertical-position adjustably mounted sensor elements 71 and emergency stop dogs 72 via bolts and nuts. The sensors 71 are used for purposes of uppermost position stop, lowermost position stop, and emergency stop and, together with emergency stop dogs 72, are arranged at predetermined vertical positions. Where so required, they are arranged in laterally spaced relation. Chain guide elements 73 are attached to the inside mounting dovetail grooves 69 via bolts and nuts. On the bracket 42 side of the maintenance elevator 40 there are mounted sensor means 77 orientatively opposite to the sensor elements 71, and sensor means (limit switch) 78 operative to act on the emergency stop dogs 72.

On the outer side of the post 12 at a location adjacent the lower frame 11 are disposed a motor 130 and a reduction gear 131 for actuating the maintenance elevator 40 to move upward and downward, with a toothed drive wheel 132 mounted to an output shaft from the reduction gear 1 and a freely rotatable toothed wheel 133 disposed on the upper frame 13 side. A pair of chains 134, right and left, are trained between the toothed wheels 132 and 133, the chains 134 being connected at opposite ends to the upper and lower portions of the maintenance elevator 40. In this conjunction, intermediate portions of the respective chains 134 are positioned between the chain guide element 73 and the chain guide portion 70 for being guided without deflection. A control panel 135 for controlling the maintenance elevator 40 and otherwise is disposed at a location outward of the motor 130 and reduction gear 131.

On the bracket 42 side of the maintenance elevator 40 there is provided a fall preventive device 140 operative to act on the engagement portion 64. The fall preventive device 140, disposed at a connection between the upper end of the chains 134 and the maintenance elevator 40, has a box frame-like body 141 made integral with the bracket 42. The ceiling of the body 141 is formed with a pair of vertically extending through-holes 142 into which are inserted from above pins 143 connected to the upper ends of the chains 134.

A shaft mounting plate 144 is provided which fits on both of the pins 143, the pins 143 having respective threaded portions 143*a* formed at their lower ends which are threadedly engaged by nuts 145 disposed below the plate 144. On the upper side of the plate 144 there are provided a pair of spring holders 146 which fit on the pins 143, the spring holders 146 each having a first compression coil spring 147 disposed therein, the top portion of the compression coil spring 147 being brought into abutment against the ceiling of the body 141 from below to resiliently urge the plate 144 downward via the spring holder 146.

A shaft 148 depends from the plate 144 centrally between the pins 143 and has a washer 149 and a block 150 fitted thereon from below. There is provided a nut 151 which goes into thread engagement with a threaded portion 148*a* formed on a lower portion of the shaft 148. The block 150 has a laterally extending horizontal pin 152.

A case member 155 is provided beneath the body 141. The case member 155 comprises a longitudinally rectangular base portion 156, a pair of arm portions, right and left, 157 extending from the base portion 156 toward the engagement portion 64, and pad receiving portions 158 fixed to the free ends of the arm portions 157. The pad receiving portions 158 have respective step portions 159 opening at their opposed sides and outwardly oriented sides, opposed surfaces of the stepped portions being formed as inclined guide faces 159*a* which come closer to each other in the upward direction.

A cover member 160 is provided for closing the outer opening of each of the stepped portions 159. Each cover member 60 is fixed to the respective pad receiving portion 158 via a bolt 161. A pad 162 disposed in each stepped portion 159 is of wedge-shaped and has an inclined surface which, as an inclined guided surface 162*a*, goes in abutment with the inclined guided surface 159*a* of the stepped portion 159. Opposed parallel surfaces of the pads 162 define flat holding surfaces 162*b*.

Between the arm portions 157 of the case member 155 there are vertically pivotably mounted a pair of links, right and left, 166 via a transversely extending support shaft 165. These links 166 are mounted at central portions thereof on the support shaft 165, their inner ends being pivotally connected to the horizontal pin 152 of the block 150 with respect to each other. Outer ends of the respective links 166 are pivotally connected to the lower portions of the respective pads 162 via a transversely extending pin 167 with respect to each other.

Between the upper portions of the arm portions 157 there is provided a shaft guide 168 which permits the shaft 148 to be inserted therein, and between the shaft guide 168 and the washer 149 there is provided a second compression coil spring 169 which urges the shaft 148 downward via the washer 149 and block 150. Therefore, the pads 162 are resiliently urged by the second compression coil spring 169 for abutment against the abutment surfaces 64*a*. When a suspension tension is acting on the chains 134, the foregoing elements 143 to 161, and 165 to 68 constitute interlocking means for moving the pads 162 away from each other against the resilient urging force.

According to this still another embodiment, the operator, having got on the maintenance elevator 40, actuates the motor 130 to run the chains 134 forward and reverse in accordance with a control instruction issued, whereby the maintenance elevator 40 can be moved upward along the guide rail 60.

During the above described vertical movement of the maintenance elevator 40, a suspension tension is acting on the pins 143 via the chains 134 and, therefore, the maintenance elevator 40 is being supported under suspension by the pins 143 via the plate 144, spring holders 146, and the body 141, the first compression coil springs 147 being then in compressed state. The plate 144 is then positioned at an uppermost position relative to the body 141 and accordingly the block 150 which is integral with the plate 144 via the shaft 148 is in such a condition that it has been elevated against the urging force of the second compression coil spring 169, so that the links 166 are pivoted about the support shaft 165 to lower the pads 162. The descent of the pads 162 results in such a condition that the wedges have been removed, so that the holding surfaces 162*b* are moved away from the abutment surfaces 64, the fall preventive device 140 being thus rendered inoperative.

In the case of the chains 135 becoming fractured during vertical movement of the maintenance elevator 40, the suspension tension acting on the pins 143 is released; therefore, the plate 144, spring holders 146, shaft 148, and block 150 are lowered relative to the body 141 under the resilient force of the compression coil springs 147, 169. Accordingly, the links 166 are pivoted about the support shaft 165 (as indicated by arrow C in FIG. 14) to move the pads 162 upward (as indicated by arrow D in FIG. 13).

Then, as a result of the ascent of the pads 162, the inclined guided surfaces 162*a* are guided by the inclined guide surfaces 159*a* to produce a condition such that wedges have been driven, so that the holding surfaces 162*b* are moved toward the engagement portion 64 so that flat surfaces come into abutment against each other, the fall preventive device 140 being thus rendered operative. Thus, the maintenance elevator 40 is prevented from falling due to the fracture of the chains 134.

As can be seen from the foregoing embodiment, where the vertical run drive means 85 is provided in such a way that it projects upwardly from the upper surface of the lower frame 11, a maintenance and checkup operation with respect to the vertical run drive means 85 can be effectively performed irrespective of the position of the maintenance elevator 40 on the vertical path of movement thereof. The vertical run drive means 85 of such outwardly projecting type may be provided with a cover removable and capable of opening and closing as required.

What is claimed is:

1. A maintenance elevator-equipped handling apparatus comprising a travelling body having a lower frame and a post extending upwardly from the lower frame, a carriage upwardly and downwardly movable along one side of the post as viewed in the direction of movement of the travelling body, a maintenance elevator movable upwardly and downwardly along the other side of the post, a vertical run drive means disposed below a vertical movement path for the maintenance elevator and at either of the underside of the maintenance elevator or the upper surface of the lower frame, and a ladder provided in a lower portion of the post at one side.

2. A maintenance elevator-equipped handling apparatus comprising a travelling body having a lower frame and a post extending upwardly from the lower frame, a vertically movable carriage and a maintenance elevator which are guided respectively along sides of the post for upward and downward movement, a vertical run drive means for the maintenance elevator including a cord element, a fall preventive device provided on the maintenance elevator, and an aluminum made guide rail provided on the post side for guiding the maintenance elevator, said guide rail having a pair of guide portions formed therewith for guiding the maintenance elevator and an engagement portion formed between the guide portions integrally therewith and adapted to be acted upon by the fall preventive device.

3. A maintenance elevator-equipped handling apparatus as set forth in claim 2, wherein said engagement portion defines two flat abutment surfaces, right and left; wherein said fall preventive device includes a pair of pads respectively positioned opposite to the abutment surfaces and resiliently urged toward the abutment surfaces, the pads each having a flat holding surface; and wherein there is provided an interlocking means for moving the pads away from the abutment surfaces against the resilient urging force when a suspension tension is being applied to the cord element.

4. A maintenance elevator-equipped handling apparatus comprising a travelling body having a lower frame and a post extending upwardly from the lower frame, a carriage upwardly and downwardly movable along one side of the post as viewed in the direction of movement of the travelling body, and a maintenance elevator movable upwardly and downwardly along the other side of the post independently of said carriage, said maintenance elevator being provided with a gangway located opposite to said carriage, said carriage being provided with a carriage-side gangway adapted to be positioned in spaced apart opposed relation to said gangway provided on the maintenance elevator side.

5. A maintenance elevator-equipped handling apparatus comprising a travelling body having a lower frame and a post extending upwardly from the lower frame, a carriage upwardly and downwardly movable along one side of the post as viewed in the direction of movement of the travelling body, and a maintenance elevator movable upwardly and downwardly along the other side of the post independently of said carriage; said maintenance elevator having its transverse length or width rectangular to the running direction of the travelling body designed to be equal to or slightly larger than the transverse length of the post in order to be substantially smaller than the width of the travelling body, and being formed with a bay window portion projecting outward from an upper part of the maintenance elevator at least at one side as viewed widthwise of the travelling body relative to the post.

6. A maintenance elevator-equipped handling apparatus as set forth in claim 5, wherein the bay window portion of the maintenance elevator is provided with a control panel.

7. A maintenance elevator-equipped handling apparatus as set forth in claim 6, wherein the maintenance elevator has a bay window portion formed at one side of the maintenance elevator as viewed widthwise of the travelling body and a gangway formed at the other side of the lower portion thereof in opposed relation to the carriage, said carriage being provided with a carriage-side gangway adapted to be positioned in spaced apart opposed relation to said maintenance elevator side gangway.

8. A maintenance elevator-equipped handling apparatus comprising a travelling body having a lower frame and a post extending upwardly from the lower frame, a carriage upwardly and downwardly movable along one side of the post as viewed in the direction of movement of the travelling body, a maintenance elevator movable upwardly and downwardly along the other side of the post independently of said carriage, a cord element running between the lower frame side and the upper end side of the post, and a vertical run drive means disposed on the maintenance elevator side for engagement with said cord element.

* * * * *